United States Patent [19]

Vilches

[11] 4,248,428

[45] Feb. 3, 1981

[54] GAME APPARATUS AND PADDLE THEREFOR

[76] Inventor: Ernest Vilches, 3417 10th St., Tampa, Fla. 33606

[21] Appl. No.: 942,831

[22] Filed: Sep. 15, 1978

[51] Int. Cl.[2] ..... A63B 71/02; A63B 59/00

[52] U.S. Cl. ..... 273/118 R; 273/67 D; 273/127 A; 273/129 K

[58] Field of Search ..... 273/127 R, 1 C, 118 R, 273/95 H, 129 A, 67 R, 67 D, 67 DA, 67 DB,67 DC, 127 A, 129 K

[56] References Cited

U.S. PATENT DOCUMENTS

| | | | |
|---|---|---|---|
| 2,366,782 | 1/1945 | Gorsuch | 273/118 R |
| 3,024,024 | 3/1962 | Chalcroft | 273/95 H |
| 3,360,266 | 12/1967 | Wathen | 273/95 H |
| 3,464,704 | 9/1969 | Nelson | 273/127 R |
| 3,554,551 | 1/1971 | Apiki | 273/1 C |
| 3,768,809 | 10/1973 | Ciarfello | 273/95 H |
| 3,880,423 | 4/1975 | Kreag | 273/67 DC X |
| 3,994,497 | 11/1976 | Cordingley | 273/95 H |

FOREIGN PATENT DOCUMENTS

| | | | |
|---|---|---|---|
| 137/31 | 1/1932 | Australia | 273/1 C |
| 10051 | of 1884 | United Kingdom | 273/67 D |
| 3123 | of 1891 | United Kingdom | 273/67 DB |
| 744778 | 2/1956 | United Kingdom | 223/67 D |

*Primary Examiner*—Richard T. Stouffer

[57] ABSTRACT

The invention comprises a game apparatus for two or more players comprising a first and a second home plate spaced from one another for a first and a second player. Each of the first and second home plates has plural supports positioned therein for removably supporting a cross bar. Each of the first and second players is provided with a bat to guard the cross bar of the respective home plate. The first player pitches a rolling ball to the second player, whereat the second player attempts to hit the ball and prevent the ball from displacing the cross bar from the plural supports.

1 Claim, 9 Drawing Figures

GAME APPARATUS AND PADDLE THEREFOR

BACKGROUND OF THE INVENTION

1. Field of the Invention

This invention relates to amusement devices and more particularly to a game apparatus comprising a flying projectile and a first and a second bat for a first and a second player.

2. Description of the Prior Art

Various amusement games have been devised incorporating a resilient projectile and single or plural bats for directing the projectile between plural players. There are two distinct types of game apparatus incorporating these characteristics. The first type of game apparatus includes baseball wherein a batter of a first team attempts to hit a ball pitched by a second team. After a preselected number of events, the teams exchange sides and the game continues. The second type of game apparatus includes the racquet games incorporating either a net or a fixed wall wherein each team is given a racquet or a bat to propel the projectile between the first and second teams.

Although each of these types of games have contributed a substantial benefit to the amusement art, it would be desirable to provide a game apparatus combining the most beneficial features of each of these two general classes of games and provide a new and improved game apparatus for two or more players.

Therefore, it is an object of this invention to provide an apparatus which overcomes the aforementioned inadequacies of the prior art devices and provides an improvement which is a significant contribution to the advancement of the amusement art.

Another object of this invention is to provide a game apparatus for two or more players comprising a first and a second home plate which may be readily played in an open play area and with plural supports positioned within the first and second home plates for removably supporting a first and a second cross bar. Each of the players is given a bat for preventing the ball being pitched by the other of the players from displacing the respective cross bar from the plural supports.

Another object of this invention is to provide a game apparatus for two or more players which may be readily played in any open area and may be set up with a minimum amount of effort and equipment.

Another object of this invention is to provide a game apparatus for two or more players which may be economically produced and readily transported to various open play areas.

Another object of this invention is to provide a game apparatus for two or more players comprising a first and a second bat with each bat being specifically designed to have a handle member and a paddle member at one end thereof with the terminal end of the paddle member forming an acute angle with the handle member for defending the cross bar from the rolling ball.

Another object of this invention is to provide a game apparatus for two or more players wherein each of the first and second cross bars are removably disposed on a first and second plural supports which plural supports are secured to the ground by support spikes extending into the surface of the playing area.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims, taken in conjunction with the accompanying drawings.

SUMMARY OF THE INVENTION

The invention is defined by the appended claims to cover the embodiments and their equivalent as set forth in the detailed discussion and drawings. For the purposes of summarizing the invention, the invention may be incorporated into a game apparatus for a first and a second player comprising a first and a second home plate spaced from one another in an open play area for the first and second player respectively. A first and a second plural supports are positioned within the first and second home plates. First and second cross bars are removably disposed upon the first and second plural supports. A first and a second bat is provided for the first and second players to prevent a resilient ball which is pitched by one of the players from displacing the cross bar from the plural supports of the other of the players.

In a more specific embodiment of the invention, each of the first and second home plates define a substantially square home plate area. The home plate areas may be defined by a plurality of longitudinal members defining the outer perimeter of the home plate area. Plate securing means may be provided for securing each of the longitudinal members to the open play area. The securing means in one embodiment includes plate spikes extending into the surface of the open play area. The first and second supports include support securing means for securing the first and second plural supports to the home plate. The support securing means may include support spikes extending into the surface of the home plate. In still a more specific embodiment of the invention, each of the first and second plural supports comprises a substantially cylindrical member with an aperture extending along the axis of the cylinder. The support spikes each comprise a head portion and a tip portion with a shank portion interposed therebetween. The apertures within the first and second supports include a countersink for receiving the head portion of the support spike when the spike extends through the aperture.

An important feature of the game apparatus comprises the first and second bats each having a handle portion and a paddle portion. The paddle portion has a thin and elongated shape extending from the axis of the handle portion. The handle portion generally comprises a substantially uniform cross-section along the length thereof, such as a uniform diameter shaft. The terminal end of the paddle portion forms an acute angle with the axis of the handle portion enabling the player to contact a ball rolling on the play area while the player is in a standing position.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Figure 1:
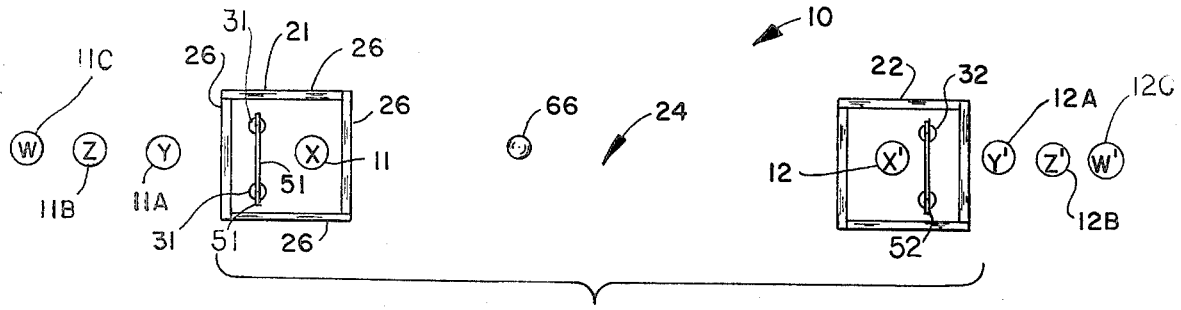
FIG. 1 is a plan view of the game apparatus.

Similar reference characters refer to similar parts throughout the several views of the drawings. For a more clearer understanding of the invention, the following number identifications taken in conjunction with the detailed description and the drawings set forth the preferred mode or practice of the invention:

10—game apparatus
11—batter
11A—pitcher-catcher
11B—shortstop
11C—outfielder
12—batter
12A—pitcher-catcher
12B—shortstop
12C—outfielder
21—first home plate
22—second home plate
24—open play area
26—longitudinal members
28—plate spikes
31—first plural support
31A—top horizontal surface
34—aperture
36—countersink
38—support spike
40—head
42—tip
44—shank portion
51—first cross bar
52—second cross bar
56—bat
58—handle
60—terminating projection
62—blade
64—terminating edge
66—resilient ball

DETAILED DESCRIPTION

Figure 2:
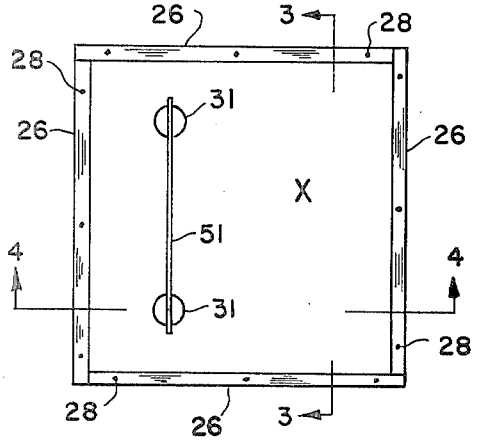
FIG. 2 is an enlarged plan view of one of the home plate areas shown in FIG. 1.
Figure 3:
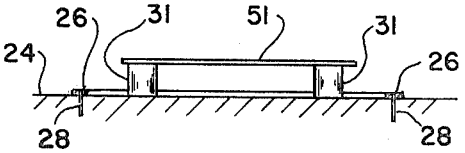
FIG. 3 is a sectional view along line 3—3 of the home plate shown in FIG. 2.
Figure 5:
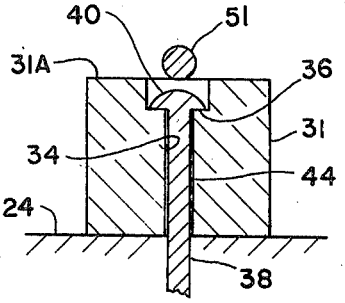
FIG. 5 is a magnified sectional view showing one of the supports shown in FIGS. 1–4.
Figure 4:
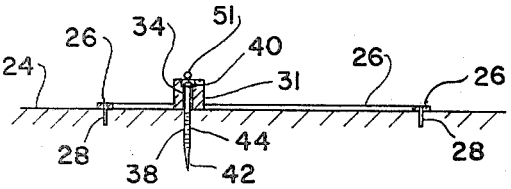
FIG. 4 is a sectional view along line 4—4 of the home plate shown in FIG. 2.
Figure 7:
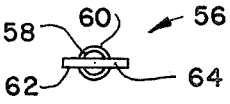
FIG. 7 is an end view along line 7—7 of the novel bat shown in FIG. 6.

FIG. 1 illustrates a game apparatus 10 for a first and a second player shown as 11 and 12 respresentative of a first and a second team. It should be understood that the game 10 may be played with two or more players including optional players 11A, 11B and 11C and 12A, 12B and 12C. The first and second players 11 and 12 are batters whereas players 11A and 12A are pitcher-catchers, players 11B and 12B are shortstops, and players 11C and 12C are outfielders. A first and a second home plate 21 and 22 are spaced from one another at a preferred spacing of approximately 20 feet on an open play area 24 such as an open field, beach or the like. The first and second home plates 21 and 22 may be defined by a marking on a hard surface such as chalk, paint or the like. In the alternative, the home plates 21 and 22 may comprise a plurality of longitudinal members 26 shown more fully in FIGS. 2–4. The longitudinal members 26 are shown as thin strip members such as plastic strips or the like, having plate securing means shown as plate spikes 28 for extending into the surface of the play area 24 to define the outer perimeter of a substantially square home plate. Preferably, each of the longitudinal members comprises a 42 inch long by 2 inch wide strip which may be readily transported and assembled into the home plate as shown in FIGS. 2–4.

The game 10 comprises first and second plural supports shown as 31 and 32 each respectively received within the first and second home plates 21 and 22. The first plural supports 31 are shown more fully in FIGS. 2–5 and it should be understood that the second plural supports 32 are substantially identical. The first plural supports 31 in the preferred form comprises a substantially solid cylindrical member having an aperture 34 extending along the axis of the cylinder. The aperture 34 includes a countersink 36 in the upper region of the cylindrical support 31. The first and second plural supports 31 and 32 are secured to the play area 21 within the first and second home plates 21 and 22 by securing means shown as support spikes 38. Each support spike 38 has a head 40, a tip 42 and a shank portion 44 interposed therebetween. The countersink 36 receives the head 40 therein when the tip 42 extends into the surface of the play area 24. A first and a second cross bar 51 and 52 are removably disposed upon the first and second plural supports 31 and 32. In this embodiment, the first cross bar 51 rests on the top horizontal surface 31A of the first plural supports 31. A similar configuration exists for the second plural supports 32. The cross bars 51 and 52 are preferably made of a synthetic material such as a $\frac{3}{8}$ inch fiberglass rod being 30 inches in length. The plural supports 31 and 32 raise the cross bars 51 and 52 approximately $2\frac{1}{2}$ inches above the surface of the play area 24.

Figure 6:
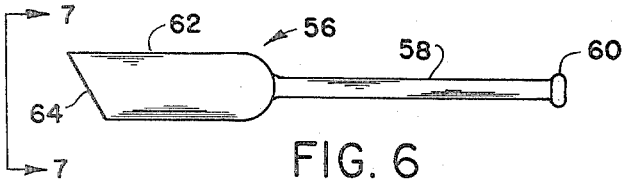
FIG. 6 is a plan view of a bat specifically contoured for use with the game apparatus.
Figure 9:
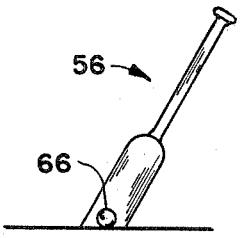
FIG. 9 is an elevational view showing the bat of FIGS. 6–8 in the playing position.
Figure 8:
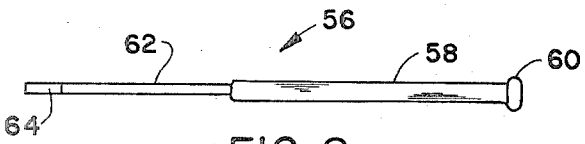
FIG. 8 is a side elevational view of the novel bat shown in FIG. 6.

Each of the first and second players 11 and 12 is given a bat 56 which is shown more fully in FIGS. 6–9. The bat 56 comprises a handle 58 having a substantially uniform cross-sectional area, such as a constant round diameter. A terminating safety projection 60 is disposed on one end of the handle 58. A paddle-like blade 62 is secured to the other end of handle 58. The blade 62 is relatively wide and thin with substantially parallel linear sides and substantially flat parallel faces as shown in FIGS. 6–9, and having a terminating edge 64 which is substantially linear from one of the sides to the other of the sides, wherein the edge forms an acute angle substantially less than 90 degrees with the axis of handle 58 as shown in FIG. 6. The terminating edge 64 enables a standing player to field a resilient ball 66 when the ball is close to the surface of the play area 24 as is more fully shown in FIG. 9.

The game may be played by two, four, six or more persons per team and as it can be seen from the apparatus required, may be played at various places such as beaches, parks, grass fields, tennis courts or any other relatively level surface. The game basically comprises the first and second players 11 and 12 being on a first and a second team. The first team comprises players 11, 11A, 11B and 11C whereas the second team comprises players 12, 12A, 12B and 12C. The number of points required to win a game is agreed on before the game is started. Normally, the game may be 20, 30, 40, etc. up to and including 100 points. The team to bat first is determined by the toss of a coin. In this case we will assume that the second team comprising players 12, 12A, 12B and 12C is first to bat. The ball is pitched by pitcher-catcher 11A by rolling the resilient ball on the ground similar to a bowling ball. The batter 12 attempts to hit the rolling ball before the ball knocks down the second cross bar 52. If the batter misses the ball and the ball knocks the cross bar 52 off of the second plural support 32 then this is considered one out and the pitcher-catcher 12A then takes position in the second home plate 22 and is considered the batter. Shortstop 12B moves to the pitcher-catcher position whereas the original batter 12 moves to the outfield position. The ball is again pitched by the first pitcher-catcher 11A and again the batter attempts to hit the ball prior to the ball knocking off the cross bar. If the batter swings at the ball three times and misses, he is considered out. If the batter hits a fly ball and it is caught by one of the players on the first team, he is also out. If the batter hits the ball on the ground, the batter exchanges bases between the second home plate 22 and the first home plate 21 as many times as possible before the first team can field the ball, transfers the ball to the pitcher-catcher 11A at which time the pitcher again rolls the ball to knock second cross bar 52 off of the plural supports 32. Each base counts two points for the batting team. Once a team obtains three outs, the second team will then pitch the ball to the first team in a similar manner.

It should be appreciated that the use of the cross bars 51 and 52 provide a means whereby a batter can exchange bases while the other team fields the ball and makes a play at home plate. Accordingly, the play at a home plate occurs when the pitcher rolls the ball to knock off the cross bar. For example, two players cannot play a game of baseball since the fielding of a ball by the fielder lacks a catcher at home plate as the batter exchanges bases. The present invention overcomes this disadvantage of the game of baseball and enables only two players to provide a similar game which develops skill and provides pleasant exercise. The game is ideal for both children and adults alike.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been claimed:

What is claimed is:

1. A game apparatus for a first and a second player, comprising in combination:

a first and a second home plate spaced from one another in an open play area for the first and second player, respectively;

each of said home plates comprising a plurality of longitudinal members for defining the outer perimeter of a home plate area;

said longitudinal members comprises thin strip members;

plate securing means for securing each of said longitudinal members to the open play area;

each of said plate securing means includes plate spikes extending into the surface of the open play area;

first and second plural supports positioned within said first and second home plates;

each of said first and second supports includes support securing means for securing said first and second plural supports to the home plate;

said support securing means includes a support spike extending into the surface of the home plate area;

a first and a second cross bar removably disposed upon said first and second plural support;

a resilient ball;

a first and a second bat for the first and second players to prevent the ball being pitched by the other player from displacing the respective cross bar from said first and second plural supports;

each of said first and second bats comprises a handle portion and a paddle portion;

said paddle portion has the substantial shape of a paddle;

said paddle portion and said handle portion being integrally formed with one another;

said handle portion comprises a substantially uniform cross section along the length thereof;

said paddle portion substantially symmetrically disposed about the axis of said handle portion up to a distal end portion of said paddle portion, said paddle portion including substantially flat parallel faces and substantially parallel linear sides;

the terminal end of said paddle portion being substantially linear from one of said sides to the other of said sides and forming an acute angle substantially less than 90 degrees with the axis of said handle portion;

said terminal end of said paddle portion being substantially bisected by the axis of said handle portion;

said first and second plural supports includes an aperture extending therethrough;

said support spike comprising a head portion and a tip portion and a shank portion;

countersink means in said apertures of said first and second plural supports for receiving the head portion of said support spike when said spike extends through said aperture; and each of said first and second plural supports are substantially cylindrical with said apertures extending along the axis of said cylinder.

* * * * *